US011466474B2

(12) United States Patent
Ellefred et al.

(10) Patent No.: US 11,466,474 B2
(45) Date of Patent: Oct. 11, 2022

(54) MAGNETIC LOCK

(71) Applicants: Joerg Ellefred, Rehda-Wiedenbrueck (DE); Felix Kaupmann, Rheda-Wiedenbrueck (DE)

(72) Inventors: Joerg Ellefred, Rehda-Wiedenbrueck (DE); Felix Kaupmann, Rheda-Wiedenbrueck (DE)

(73) Assignee: SIMONSWERK GMBH, Rheda-Wiedenbrueck (DE)

( * ) Notice: Subject to any disclaimer, the term of this patent is extended or adjusted under 35 U.S.C. 154(b) by 224 days.

(21) Appl. No.: 16/736,889

(22) Filed: Jan. 8, 2020

(65) Prior Publication Data

US 2020/0224455 A1 Jul. 16, 2020

(30) Foreign Application Priority Data

Jan. 11, 2019 (DE) ..... 102019100637.6

(51) Int. Cl.
*E05B 47/00* (2006.01)
*E05C 19/16* (2006.01)

(52) U.S. Cl.
CPC ..... *E05B 47/004* (2013.01); *E05C 19/163* (2013.01); *E05C 19/168* (2013.01)

(58) Field of Classification Search
CPC ..... E05B 47/004; E05B 47/0038; E05B 47/0042; E05B 47/0046; E05B 47/0047; E05B 15/022; E05C 19/163; E05C 19/168; E05C 1/004; E05C 1/02; E05C 19/16; E05C 19/003; E05C 17/56; Y10T 292/11; Y10T 292/096; Y10T 292/0949; Y10T 292/1001; Y10T 292/0886; Y10T 292/0893; Y10T 292/696; Y10T 292/702; Y10T 292/306; Y10T 292/307
See application file for complete search history.

(56) References Cited

U.S. PATENT DOCUMENTS 3,288,511 A * 11/1966 Tavano ..... E05C 19/16 16/87 R
3,326,588 A * 6/1967 Clark ..... E05C 19/16 292/251.5

(Continued)

FOREIGN PATENT DOCUMENTS

DE 2904995 A1 8/1980
DE 3942379 U 7/1990

(Continued)

*Primary Examiner* — Victor D Batson
*Assistant Examiner* — Tal Saif
(74) *Attorney, Agent, or Firm* — Andrew Wilford

(57) ABSTRACT

A magnetic lock has a magnetically operable latch having a magnetically repellable or attractable latch element. A magnetic operating device spaced from the latch has a first magnet with a respective magnetic direction and a second magnet with a respective magnetic direction. The first magnet is rotatable between a latched position with its magnetic direction generally parallel to and pointing oppositely to the magnetic direction of the second magnet for contracting a magnetic field formed by the first and second magnets, and a release position generally parallel to and with its magnetic direction pointing the same as the second magnet for extending the magnetic field to and repelling or attracting the latch element.

15 Claims, 7 Drawing Sheets

(56) References Cited

U.S. PATENT DOCUMENTS 3,782,147 A * 1/1974 Hallmann ..... E05B 47/0042 70/276
4,425,771 A * 1/1984 Beach ..... E05B 47/0038 70/276
4,686,841 A * 8/1987 Prunbauer ..... E05B 47/0042 70/276
5,367,891 A * 11/1994 Furuyama ..... A44C 5/2057 63/3
5,485,733 A * 1/1996 Hoffman ..... E05B 65/46 70/276
6,658,697 B2 * 12/2003 Liao ..... E05F 5/02 24/303
6,707,360 B2 3/2004 Underwood
7,267,378 B2 * 9/2007 Drumm ..... E05C 19/163 292/DIG. 60
8,397,546 B2 * 3/2013 Varney ..... E05B 47/004 70/276
8,641,105 B2 * 2/2014 Goodman ..... H01F 7/04 292/251.5
9,051,764 B1 * 6/2015 Rafter ..... E05B 65/0067
10,815,690 B2 * 10/2020 Mohammed ..... E05B 47/0038
2002/0105400 A1 8/2002 Underwood et al.
2006/0049645 A1 * 3/2006 Drumm ..... E05C 19/163 292/251.5
2009/0273194 A1 * 11/2009 Patterson ..... H01F 7/04 335/306
2011/0018659 A1 * 1/2011 Fullerton ..... H01F 7/0284 335/295
2012/0131967 A1 * 5/2012 Sanchez Giraldez ..... E05B 47/0038 70/276
2012/0187703 A1 7/2012 Goodman et al.

FOREIGN PATENT DOCUMENTS

DE 202004009405 U * 8/2004 ..... E05B 41/00
DE 202004009405 U1 * 8/2004 ..... E05B 41/00
EP 3266963 A1 * 1/2018 ..... E05B 47/004
GB 1321834 A 7/1973
KR 200373366 Y1 * 1/2005 ..... E05B 47/004
WO WO-2009000008 A1 * 12/2008 ..... E05B 47/0038

* cited by examiner

MAGNETIC LOCK

FIELD OF THE INVENTION

The present invention relates to a magnetic lock. More particularly this invention concerns such a lock where a lock operating device on a movable element controls a latch on an adjacent fixed element via a magnetic-field coupling. The invention also relates to a door assembly latchable by such a magnetic lock.

BACKGROUND OF THE INVENTION

The operating device of such a latch has a first magnet of a magnet assembly that can be rotated about an axis of rotation between a closing position (first functional position) and a release position (second functional position). Due to the magnetic field of the magnet assembly, the latch is locked in the closing position of the operating-device magnet.

Numerous applications are known from the literature in which a latch can be magnetically controlled by a rotatable magnet of an operating device. The latch is designed to prevent the movement of another object such as for example a door panel, for example, when locked. For example, such a magnetic lock is known from U.S. Pat. No. 7,267,378 where one or more bolts can be moved by a rotatable magnet to lock a door.

One disadvantage of such arrangements, however, is that the driving magnet must have a high field strength in order to ensure secure magnetic coupling with the bolt. The magnetic counterparts of the bolts are in the immediate vicinity of the main magnet in order to improve the magnetic coupling. Force transmission over spacings of several centimeters is out of the question. Furthermore, strong magnetic fields are also disruptive, as they may have unwanted effects on medical devices such as pacemakers or on magnetic storage media such as hard disks or credit cards.

Objects of the Invention

It is therefore an object of the present invention to provide an improved magnetic lock.

Another object is the provision of such an improved magnetic lock that overcomes the above-given disadvantages, in particular that with which a secure magnetic coupling between the operating device and the latch can be achieved over long spacings, particularly of greater than 2 cm.

Yet another object is to minimize unwanted side effects of the triggering magnetic field.

SUMMARY OF THE INVENTION

A magnetic lock has according to the invention a magnetically operable latch having a magnetically repellable or attractable latch element. A magnetic operating device spaced from the latch has a first magnet with a respective magnetic direction and a second magnet with a respective magnetic direction. The first magnet is rotatable between a release position with its magnetic direction generally parallel to and pointing oppositely to the magnetic direction of the second magnet for contracting a magnetic field formed by the first and second magnets, and a closing position generally parallel to and pointing the same as the magnetic direction of the second magnet for extending casting the magnetic field to the latch element for operating same.

Here and below the "magnetic direction" is the direction vector that characterizes the magnet's overall magnetic properties. For a bar magnet, the direction of the magnetic moment points from the magnet's south pole to its north pole. Thus in a bar or cylinder magnet this direction is parallel to a center axis of the magnet.

The physical spacing between the first magnet and the second magnet of the magnet assembly is particularly less than the spacing between the magnet assembly and the closing arrangement, particularly the part of the closing arrangement that interacts magnetically with the magnet assembly. Preferably, the spacing between the magnet assembly and the closing arrangement is at least twice as great as the spacing between the two magnets.

The invention is based on the discovery that two separate magnets of a magnet assembly taken individually each form an individual magnetic field. However, if these two magnets are brought into sufficient proximity, the two magnetic fields overlap and can be regarded as a common "far field" if the spacings are sufficiently great. Besides the strength and position of the first magnet and of the second magnet, their relative orientation is also essential for the formation of this far field. The orientation of the first magnet and the orientation of the second magnet are to be considered to be "in the same direction" if they form an angle of less than 90°, projected onto a normal plane of the axis of rotation. They are to be understood as being "in the opposite direction" if they form an angle of greater than 90°.

If two magnets are pointed in the same direction, the magnetic far field is amplified or extended, whereas it can be weakened in the case of individual magnets that are pointed in opposite directions. In particular, in the case of two magnets of similar strength that are arranged in antiparallel, an almost complete extinction of the magnetic far field can occur.

As a result, it is possible within the scope of the invention for the magnet unit to have a stronger magnetic far field in the closing position than in the release position. The magnetic far field can thus be used in a closing position for magnetic transmission over a greater spacing. At the same time, it is weakened in the release position to such an extent that it is unlikely that the latch or the environment will be affected. Since the closing position is usually assumed when the operating device does not come close to the user, this prevents damage, for example, to medical devices or magnetic storage media.

According to a preferred embodiment of the invention, the orientation of the first magnet and the orientation of the second magnet projected onto a normal plane of the axis of rotation in the closing position form an angle of less than 45°, in particular from 0° to 30°. The smaller the relative angle between the two orientations, the greater the reinforcing effect in the closing position.

Accordingly, the relative angle between the orientation of the first magnet and of the second magnet in the opening position is greater than 135°, in particular between 150° and 180°.

According to a preferred embodiment, the latch has a permanent magnet that interacts with the magnetic field of the magnet assembly. As a result, particularly large forces can be generated in the latch due to the interaction with the magnetic field.

In an alternative embodiment, the latch can also have a soft magnetic element that interacts with the magnetic field of the magnet assembly. Since the magnetic field of the magnet assembly can be almost switched "on" and "off" in the far field, such embodiments are also easy to implement.

The magnetic latch element (or the permanent magnet) can be preferably integrated into the latch so that it is locked both in an attractive interaction and in a repulsive interaction between the permanent magnet and the magnet assembly. On the one hand, this facilitates the installation of the magnetic lock, since it is not necessary to pay attention to the polarity of the magnet assembly as a function of the positioning of the latch. The control assembly can thus be universally positioned both on left-hinged doors and on right-hinged doors and, on these, both on the hinge edge and on the free edge. In addition, this also increases the safety of the magnetic lock. Since the magnetic field has to be reduced in order to unlock the latch, opening by a simple and unspecific permanent magnet is not readily possible.

Especially preferably, the orientation of the permanent magnet, at least as projected onto a normal plane of the axis of rotation, is aligned with the first magnet in the closed and/or open position. The orientations of the first magnet and of the permanent magnet extend parallel or antiparallel to one another. In the vertical direction, they are at the same height. In the thickness direction, the permanent magnet is preferably aligned horizontally with the first magnet, but it can also be disposed in the thickness direction between the first magnet and the second magnet. This enables good power transmission to be achieved between the operating device and the latch.

Especially preferably, the latch has a biasing element that unlocks it in the low-field or zero-field state, that is with the first and second magnets pointing oppositely to condense the combined magnetic field they form. This is to be understood as referring to when the magnet assembly has a magnetic field strength near the latch (particularly at the magnetically active component thereof) that is no more than twice the earth's magnetic field strength. With such a magnetic field strength, interference fields, such as the earth's magnetic field or the magnetization of the environment, are dominant in relation to the far field of the magnet assembly.

In an especially preferred embodiment, the second magnet is arranged so as to be rotatable about a second axis of rotation. By triggering such a rotational movement, the magnet assembly can also be changed between an orientation in the same direction and in the opposite direction. As a result, switching between the release position and the closing position is achieved at the same time.

A rotatable second magnet thus enables a second locking option to be implemented, such as a separate lock from the opposite side of the door or, alternatively, an emergency release.

The invention also relates to a door with a door panel that can be moved between an open position that clears the door opening at least partially and a closed position that blocks the door opening. According to the invention, the door is provided with a previously described magnetic lock. By virtue of the magnetic coupling, the operating device and the latch can be arranged separately from one another in a visually especially appealing manner. The operating device can have an especially sophisticated design. At the same time, the magnetic field induced by the operating device in the release position is low.

The latch is designed such that it prevents the door panel from leaving the closed position when in a latched position. This is achieved in particular through positive locking of the opening movement. The operating device is preferably arranged on, in particular adhesively bonded to, a first face (which extends in the lateral and vertical directions). The operating device preferably has an opening for forming a door handle in addition to the first magnet of the magnet assembly. A key-operated plug in the handle can carry the rotatable first magnet.

Especially preferably, the operating device is arranged on the door panel at a spacing from a side edge. There is a clear gap with no operating-device structure between the operating device and the latch. As a result, the operating device can be provided with the visual appearance of a handle that does not directly reveal its closing function. This can result in an elegant appearance, particularly in glass doors.

Expediently, the latch is arranged in a frame surrounding the door opening. This improves the visual appearance of the door both in the open and in the closed position, since the latch is substantially invisible.

Preferably, the second magnet of the magnet assembly is in a second possibly identical operating device on a second face that is situated opposite the first face in the thickness direction.

The door panel expediently is less than 2 cm thick. This enables the first magnet and the second magnet to be superposed magnetically through the nonmagnetic and non-shielding door panel. This is particularly useful for embodiments in which the second magnet is designed to rotate in order to provide a secondary opening and closing function.

The invention can be employed with very special preference if the door panel is translucent, light-transmitting, and/or transparent, particularly made of clear or frosted glass. As a result, the filigree design of the lock works especially well.

Expediently, the axis of rotation of the first magnet is oriented perpendicular to a front surface of the door panel. As a result, the orientation of the first magnet is parallel to the door panel, thus enabling a maximum magnetic long-spacing effect to be exercised toward the door frame. There, the associated latch is then arranged in the frame or also on the edge of the door panel.

In a first preferred embodiment, the latch has a bolt that can be displaced linearly, particularly perpendicular to the axis of rotation. Through the linear displacement, the bolt of the latch can be moved between a latched position and an unlatched position. In the latched position, the bolt prevents movement of the door panel.

According to an alternative preferred embodiment, the latch has a pivoting strike block and a magnetically actuatable latch element. The strike block locks the door panel in the closed position in a form-fitting manner when the latch element blocks a pivoting movement of the strike block.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
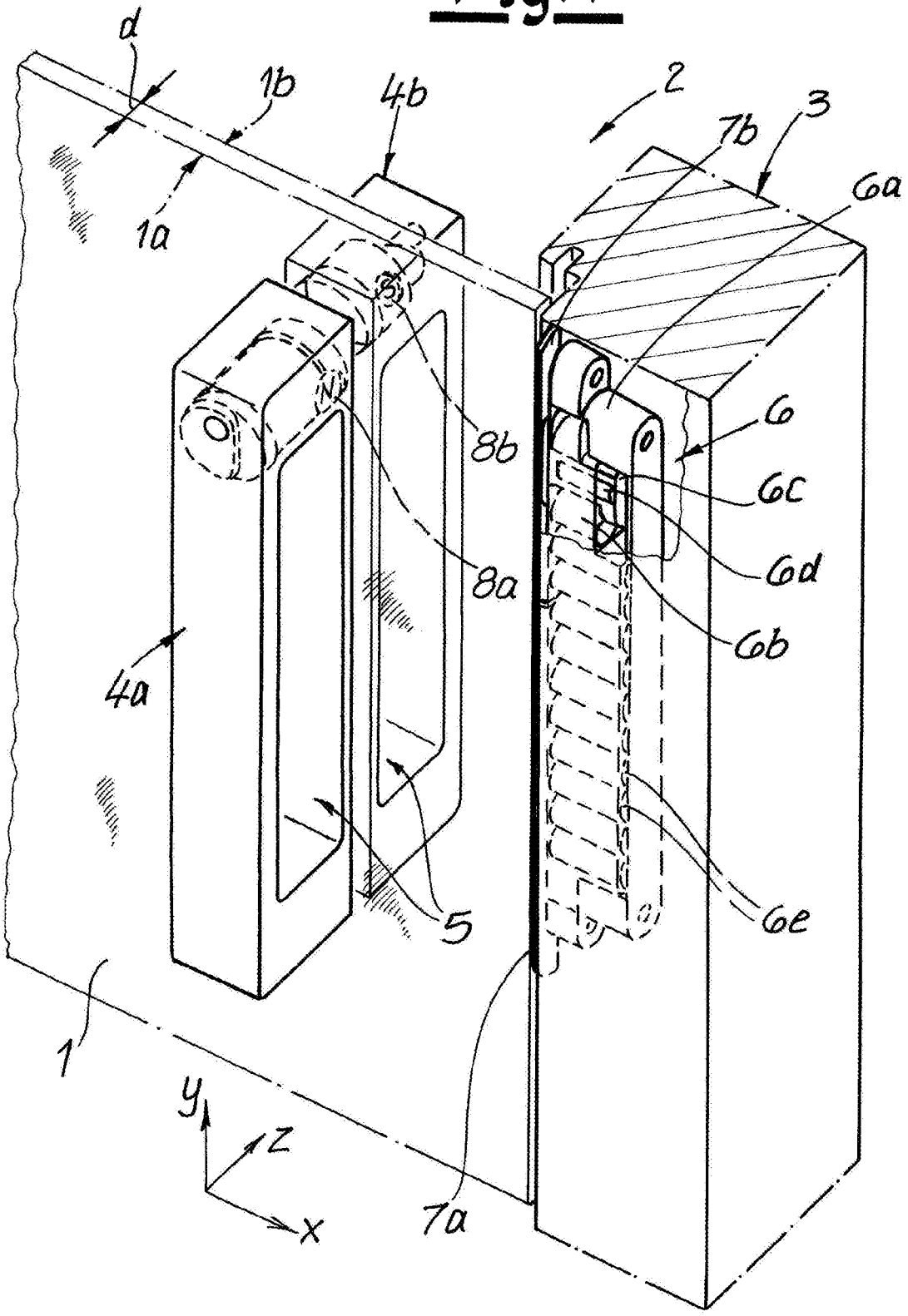
FIG. 1 is a large scale partly sectional and perspective view of the lock according to the invention.

As seen in FIG. 1 a door has a door panel 1 that is designed to close a doorway 2. The door panel 1 extends in a horizontal direction x, a vertical direction y, and has a horizontal thickness direction z perpendicular to the directions x and z. In the thickness direction z, the door panel 1 has a thickness d of less than 2 cm and particularly less than one tenth of the door panel width as measured in the horizontal direction x and of the door panel height as measured in the vertical direction y. Here the door panel 1 is a sheet of plate glass, although a door panel of any material not significantly magnetically disruptive could be used.

In the illustrated embodiment, the door panel 1 is a swinging door that is supported on a door frame 3 so as to pivot about an axis extending in the vertical direction y. According to the invention, a first operating device 4*a* of a magnetic lock according to the invention is mounted on a first face 1*a* of the door panel 1. A second operating device 4*b* is attached on a second face 1*b* opposite the first face 1*a*. The first operating device 4*a* and the second operating device 4*b* are directly across from each other in the thickness direction z at a spacing a from the nearest side edge 1*c* of the door panel and form an opening 5 in act as a door handle.

A latch 6 for blocking the pivoting movement A of the door panel 1 is set in the frame 3 that is shown in a partially cutaway view in order to make the latch 6 visible. The latch 6 comprises a housing 6*a* that is securely connected to the door frame and a support 6*b* that is displaceable therein. A bolt 6*c* is held on the support 6*b* so as to be displaceable in the horizontal direction x. A permanent magnet 6*d* is carried by the bolt 6*c*.

Furthermore, a plurality of holding magnets 6*e* are fixed in the housing 6*b* in order to stabilize for the door when closed. The holding magnets 6*e* interact with a magnetizable first sheet-metal strip 7*a* fixed to a side edge of the door panel 1 and extending in the vertical direction y over the same region as the holding magnets 6*e*.

A second, non-magnetizable sheet-metal strip 7*b*, which forms an abutment for the positive engagement of the bolt 6*c*, extends upward from the first, magnetizable sheet-metal strip. In order not to impair the magnetic closing behavior, the second sheet-metal strip 7*b* is not magnetizable. With regard to their visual appearance and cross section, the first sheet-metal strip 7*a* and the second sheet-metal strip 7*b* are adapted to or identical to one another.

Figure 2A:
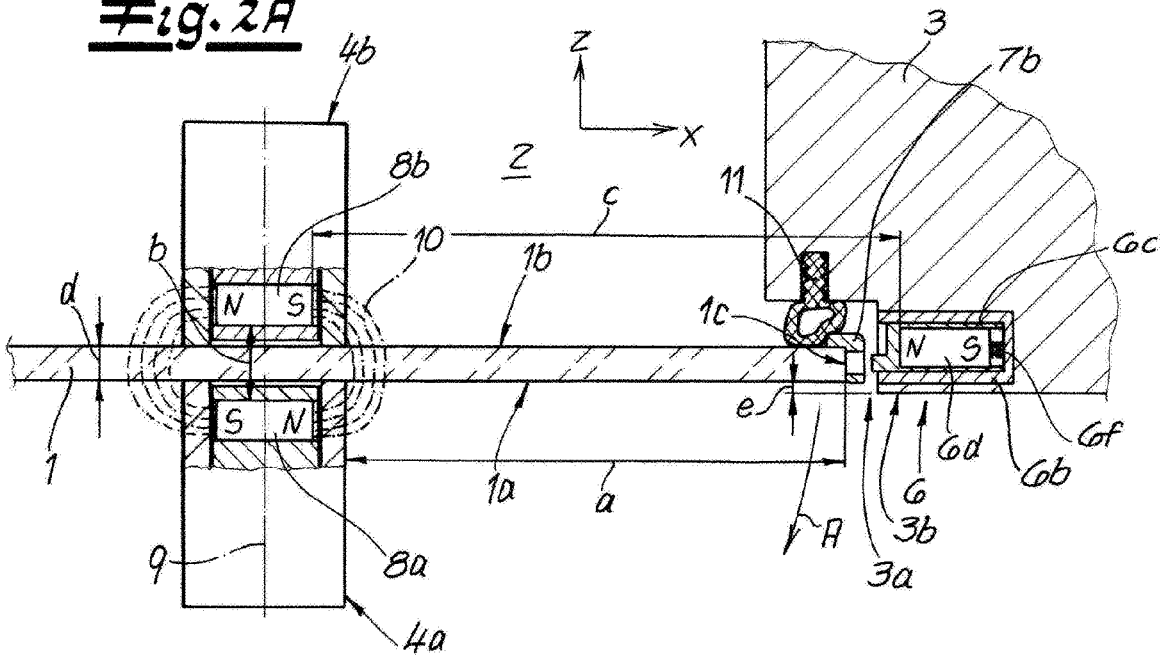
FIGS. 2A and 2B are horizontal sections through the lock of FIG. 1 in the unlatched and latched positions of the latch.
Figure 2B:
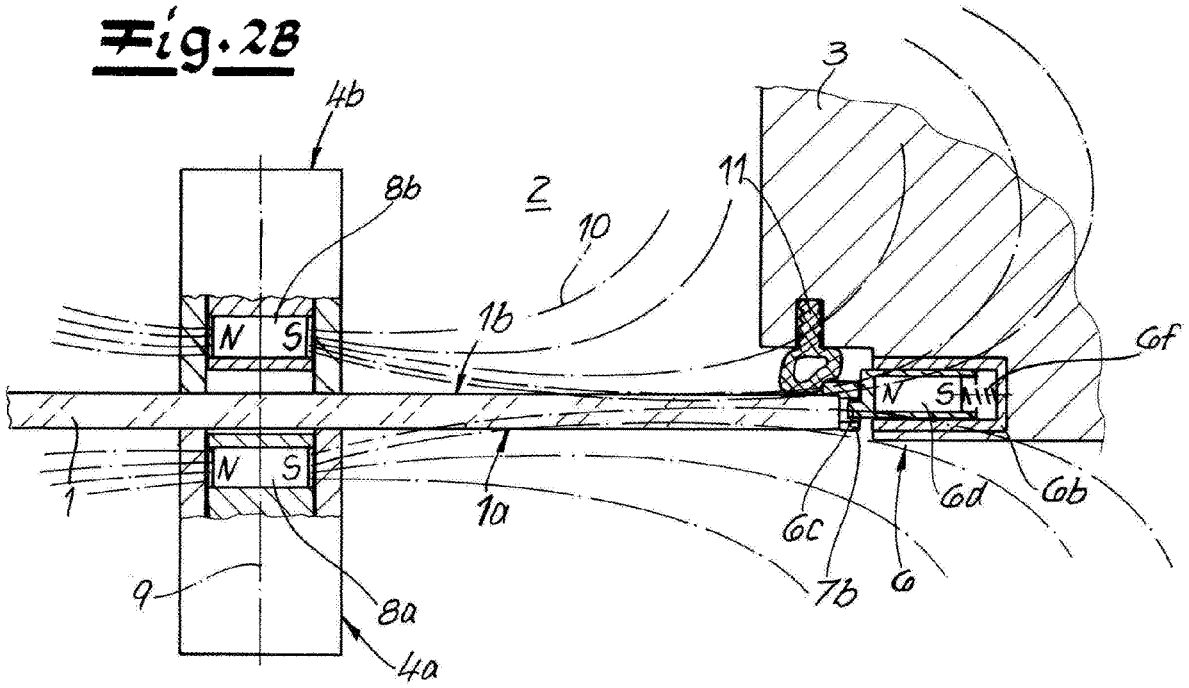

FIGS. 2A and 2B show how the first operating device 4*a* and the second operating device 4*b* have respective first and second bar magnets 8*a* and 8*b* that together form a magnet assembly 8*a*, 8*b* according to the invention. At least the first magnet 8*a* can be rotated about an axis of rotation 9, for instance by a key-operated barrel set in a door handle, between a release position shown in FIG. 2A and a closing position shown in FIG. 2B.

In the release position, the magnetic directions of the first magnet 8*a* and second magnet 8*b* are parallel and point in opposite directions. As a result, the magnetic fields weaken each other as illustrated by the dot-dash field lines 10 and form a closed and small elliptical magnetic field whose major axes extend through the magnets 8*a* and 8*b*. The magnetic far field acting on the bar magnet 6*d* of the latch 6 is therefore vanishingly small.

A spacing c between the bar magnet 6*d* and the first and second magnets 8*a* and 8*b* is substantially greater, in the embodiment by more than a factor of 3, than the spacing b between the first magnet 8*a* and the second magnet 8*b*. The magnetic interaction of the bar magnet 6*d* with the far field of the first magnet 8*a* and of the second magnet 8*b* is therefore negligible, so that the bolt 6*c* cannot be pulled out of the housing 6*b* counter to the horizontal direction x against the spring force of a return element 6*f*. The door is thus unlocked and the panel 1 can swing out of the illustrated closed position in the opening direction A (FIG. 2A).

In the illustrated embodiment, the lateral frame member 3 has a stepped edge groove 3*a* that receives an outer edge of the door panel 1. A profile seal 11 that does not project out into the doorway 2 is also provided in the stepped grove 3*a*. Likewise, the second sheet-metal strip 7*b*, which is visible in the sectional view, does not project into the doorway 2, but remains recessed in the stepped grove 3*a*. In the illustrated closed position, the face 1*a* of the door panel 1 is generally flush or coplanar with a flat outer face 3*b* of the frame member, any offset e in the thickness direction z being less than the door panel thickness d, in particular less than half the door panel thickness d.

FIG. 2B shows the closed position of the door panel 1 in which rotation of the magnet 8*a* about the axis of rotation 9 by 180° orients the first magnet 8*a* oppositely and still parallel with respect to magnetic direction to the second magnet 8*b* so both magnets have their magnetic directions pointing the same way. The far field of the two magnets 8*a*, 8*b* is thus combined or in effect cast, as can be seen from the dot-dash field lines 10. Due to the amplified far field, a magnetic attraction is now exerted on the bar magnet 6*d*. As a result, the bar magnet 6*d* is moved toward the door panel 1 so that the bolt 6*c* forms a form-fitting opening with the second sheet-metal strip 7*b*. This prevents the door from being moved in the opening direction A. When the magnetic field is removed again, the bolt 6*c* is urged back to its original position by the return element 6*f*.

Figure 3A:
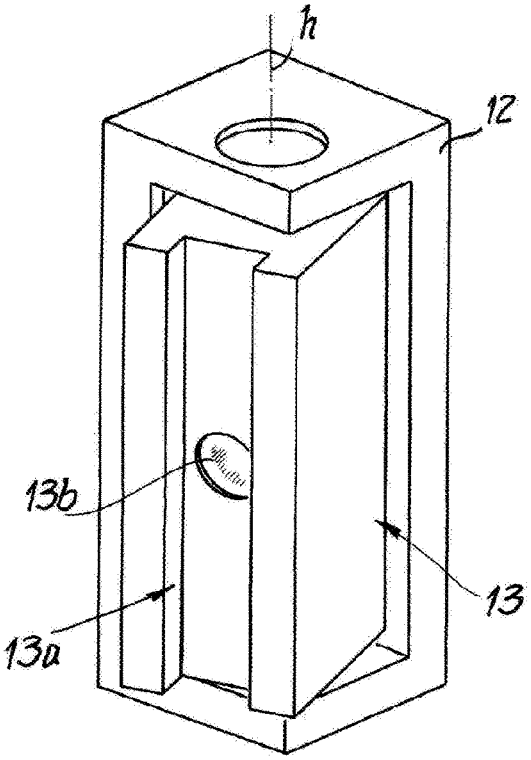
FIGS. 3A, 3B, and 3C are perspective views through the latch in various positions.
Figure 3B:
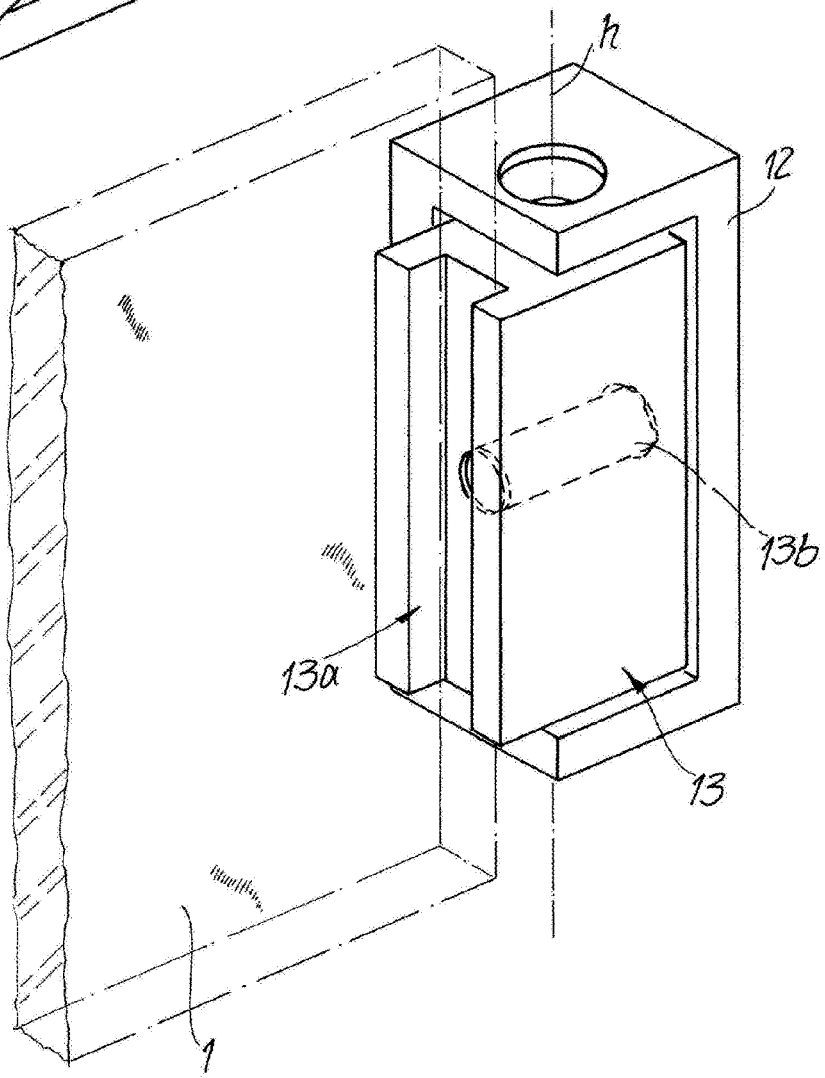
Figure 3C:
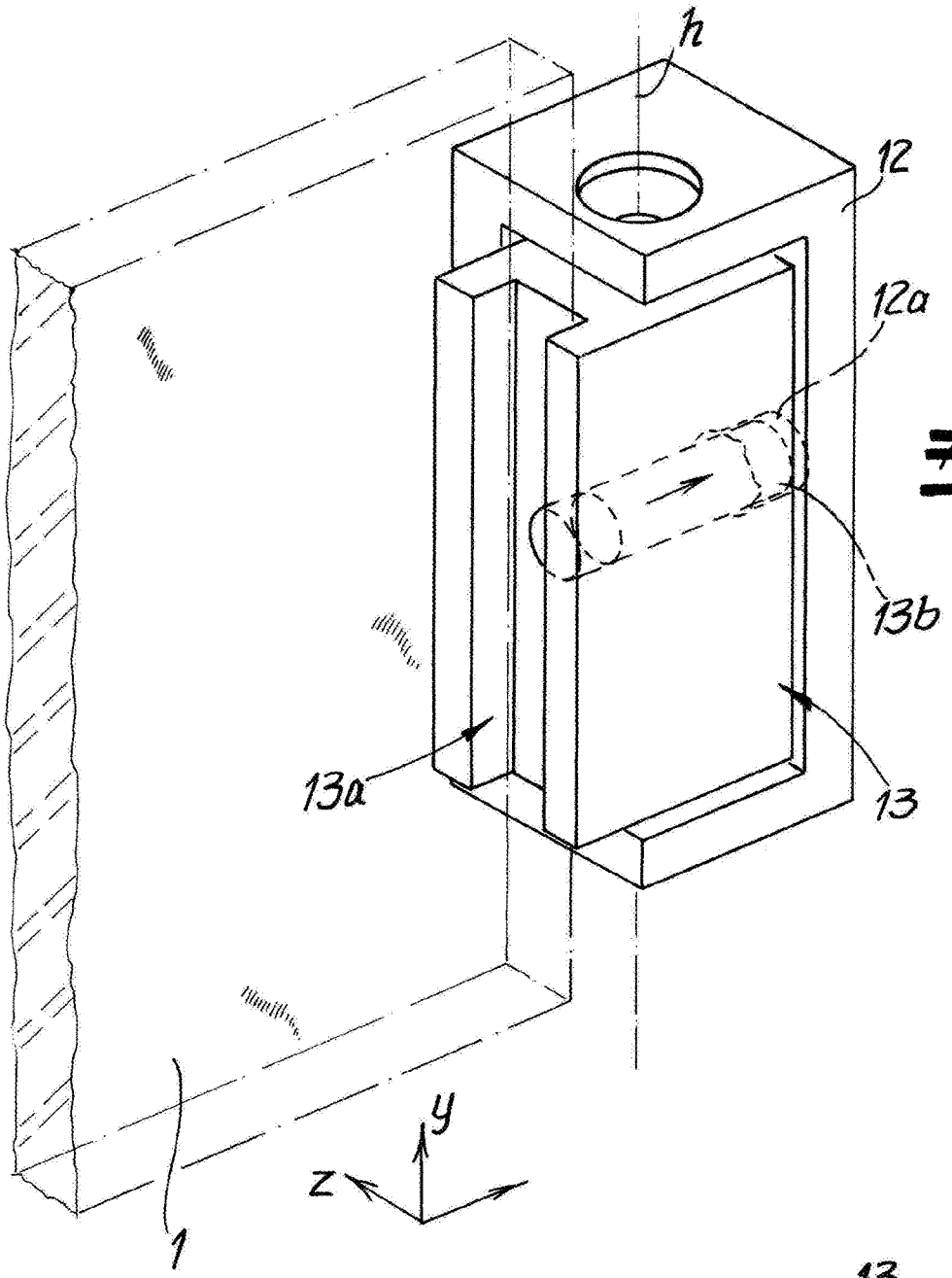
Figure 3D:
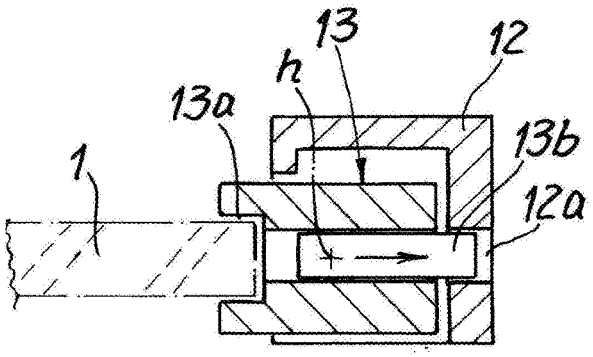
FIG. 3D is a horizontal section through the latch as in FIG. 3C.

An alternative embodiment of the closing element is shown in FIGS. 3A to 3C. The latch has a frame 12 that is connected to the door frame 3 and a strike block 13 that can be pivoted about a vertical axis h in the frame 12. The vertical axis h runs parallel to the pivot axis of the door panel 1, i.e. in the vertical direction y. Moreover, a groove 13*a* extends in the vertical direction y on the strike block 13. Upon closing of the door panel 1, the door panel 1 pivots into the groove 13*a* shortly before reaching the closed position and is complementarily surrounded by the strike block 13 in the thickness direction z. This position is illustrated in FIG. 3B. The pivoting movement about the vertical axis h can be locked by a latch element 13*b* in the strike block 13. An unlatched position is shown in FIG. 3B in which the strike block 13 can be pivoted about the vertical axis h. Magnetic interaction with the control element displaces the latch element 13*b* into a latched position as shown in FIGS. 3C and 3D. There, the latch element 13*b*, which is or includes a permanent magnet, engages in a hole 12*a* of the frame and pivotally arrests the strike block 13. Furthermore, the latch element 13*b* is in positive engagement with the strike block 13, so that pivoting about the vertical axis h is prevented. Preferably, a spring (not shown in the figures) is provided that pivots the strike block in the unloaded state into the angled rest position shown in FIG. 3A, in which the edge of the door panel 1 can pivot into the groove 13*a* and pivot the block 13 back into the latched position of FIGS. 3B-3D.

The basic principle of the magnetic lock according to the invention and various variants for driving the latch are shown in FIGS. 4A to 6C.

Figure 4A:
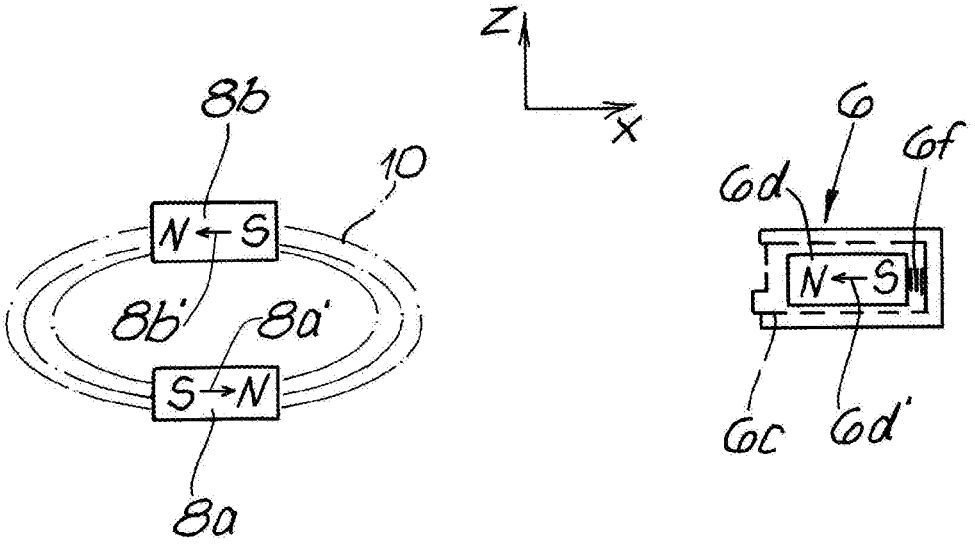
FIGS. 4A and 4B are schematic top views illustrating operation of the invention in the release and opening position, respectively.
Figure 4B:
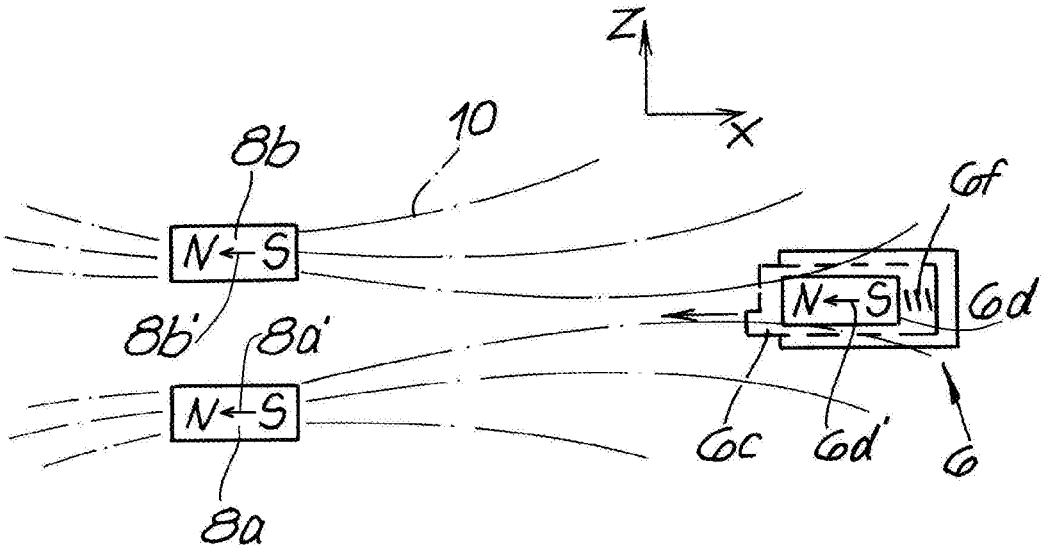

FIGS. 4A and 4B show the simplest variant also shown in FIGS. 1-2B. Here the south-to-north magnetic directions of the first and second magnets 8*a* and 8*b* are shown respectively at 8*a*' and 8*b*'. The latch 6 has the bar magnet 6*d* as a magnetically attractable or repellable component with a south-to-north magnet direction 6*d*'. The embodiment is designed to drive the bolt 6*c* only shown by a broken line. The bar magnet 6*d*, like the first magnet 8*a* and the second magnet 8*b* of the magnet assembly, is centered with its magnetic direction 6*d*' on the horizontal plane of the x-z directions. The bar magnet 6*d* is approximately centered between the first operating magnet 8*a* and the second operating magnet 8*b* in the thickness direction z.

In the open position shown in FIG. 4A, the magnetic directions 8*a*' and 8*b*' of the first and second magnets 8*a* and 8*b* are parallel but point in opposite directions, so the magnetic far field (indicated by the field lines 10) is attenuated. As a result, the bolt 6*c* is held by the return member 6*f* in a retracted release position.

In FIG. 4B the directions 8*a*' and 8*b*' of the first magnet 8*a* and magnets 8*b* are parallel and point in the same direction. The magnetic far field (field lines 10) is thereby cast or deflected outward and exerts a magnetic attraction on the bar magnet 6*d* counter to the horizontal direction x. The return element 6*f* is thereby stretched, and the bolt 6*c* is displaced to a position in which it latches the door panel 1 in the closed position.

Figure 5A:
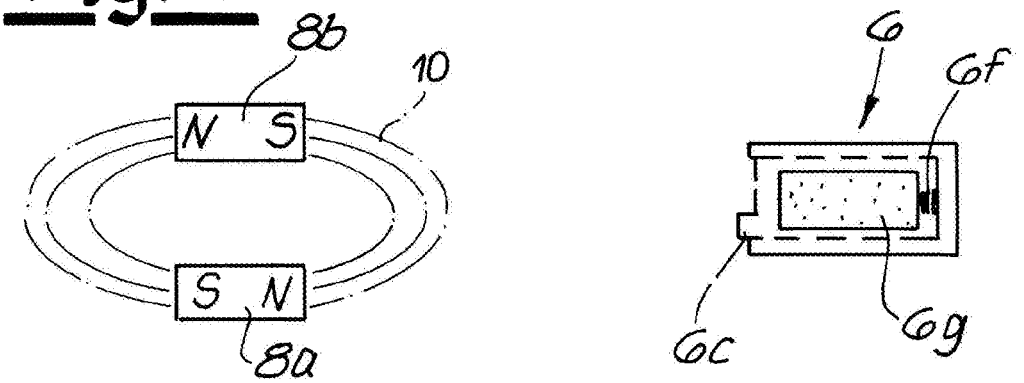
FIGS. 5A, 5B, and 5C are schematic top views like FIGS. 4*a* and 4B illustrating a second embodiment of the invention.
Figure 5B:
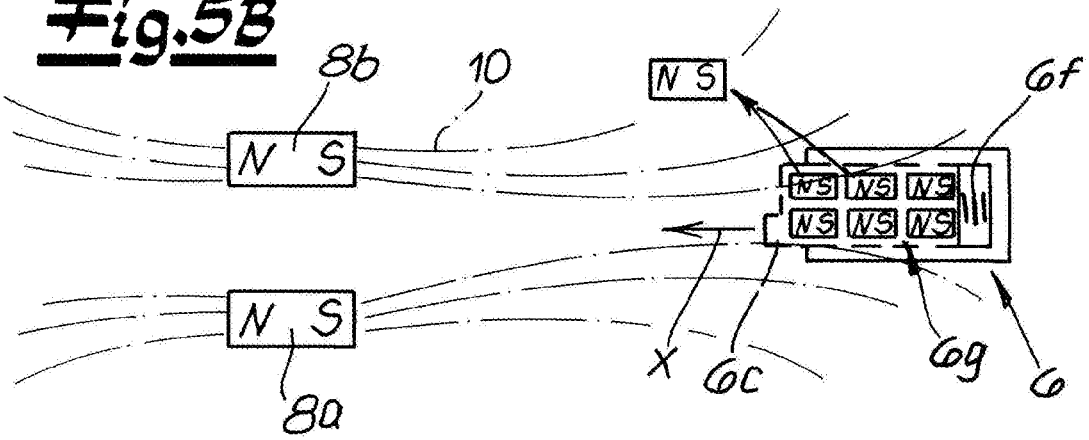
Figure 5C:
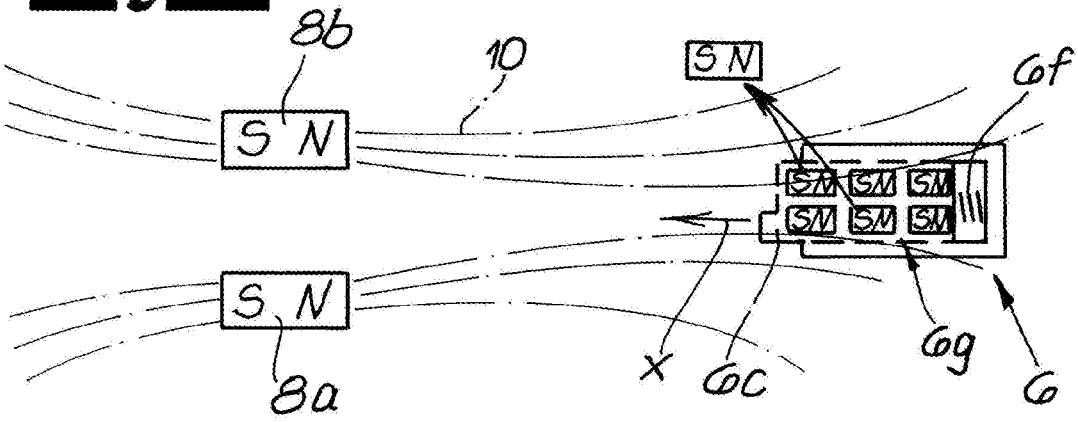

An alternative embodiment is shown in FIGS. 5A to 5C. The bolt 6*c* is driven here by a magnetizable core 6*g*. Thus, attraction by the magnets 8*a* and 8*b* aligned in the same direction is independent of the overall orientation of the far field. The elementary magnets in the magnetizable core 6*g* are respectively oriented under the influence of the magnetic far field 10 in such a way that magnetic attraction occurs. In such a configuration, the operating state between the opening position and the closing position can be achieved by rotating either the first magnet 8*a* or the second magnet 8*b*.

Figure 6A:
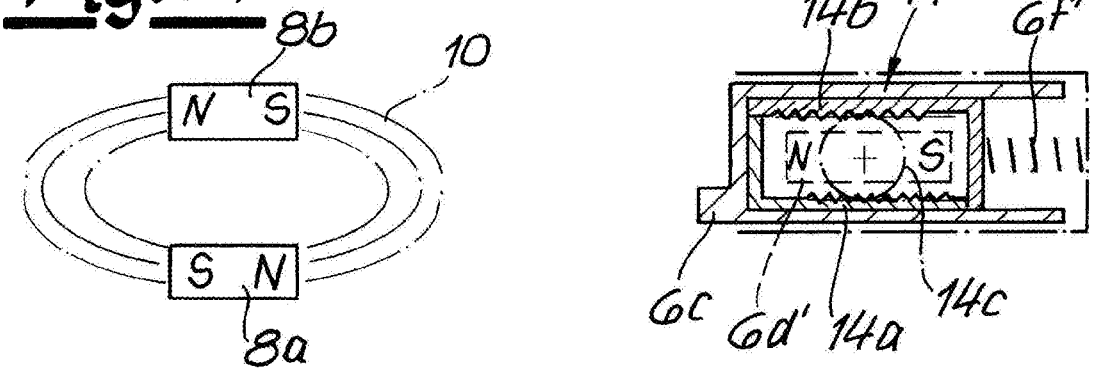
FIGS. 6A, 6B, and 6C are schematic and sectional top views also like FIGS. 4*a* and 4B showing a third embodiment of the invention.
Figure 6B:
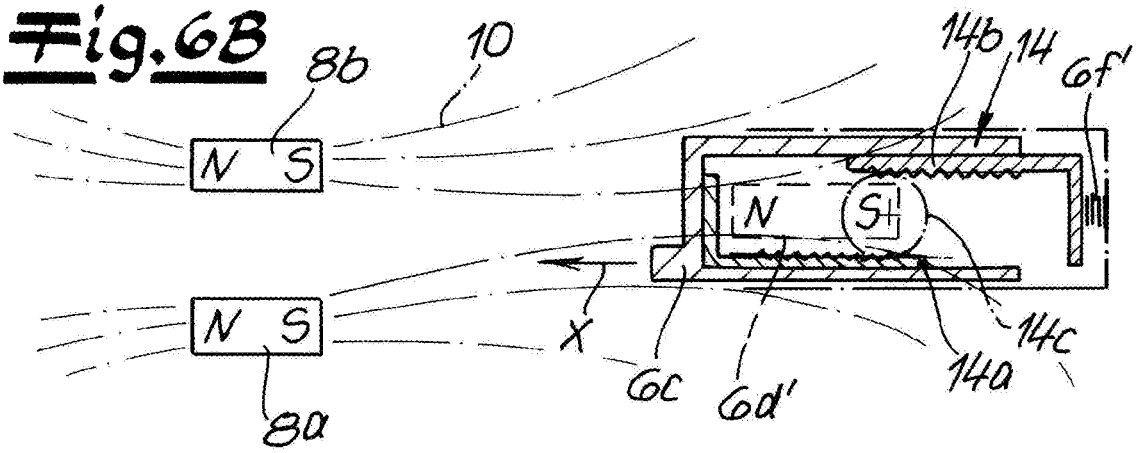
Figure 6C:
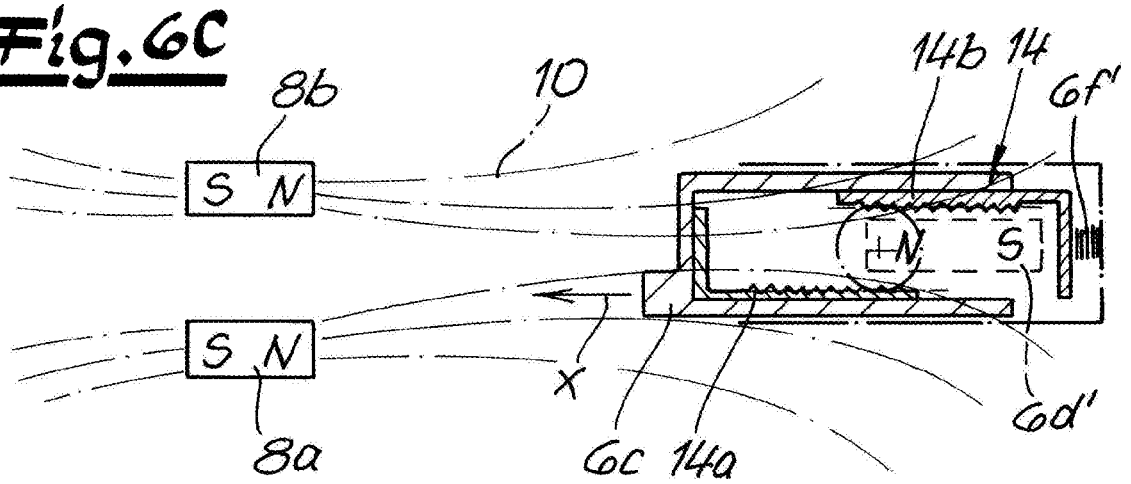

Another embodiment of the closing element, in which the latched position can be achieved independently of whether the north or the south pole of the far field is facing toward the latch, is shown in FIGS. 6A to 6C. There, a bar magnet 6*d*' is displaceable in the horizontal direction x in a multipart sleeve 14. The sleeve 14 has a first half-shell 14*a* and a second half-shell 14*b*, each of which has a surface that is formed with a gear rack facing toward the gear rack of the other half-shell. In this case, the two gear racks are coupled together by a deflection gear 14*c*. The two half-shells 14*a* and 14*b* are pressed together in the zero-field state (FIG. 6A) by a return element 6*f*' that is a compression spring. The bar magnet 6*d*' is thereby held centrally within the half-shells. Both through magnetic attraction (FIG. 6B) and by magnetic repulsion (FIG. 6C), the two half-shells 14*a*, 14*b* are pushed apart by the deflection gear 14*c* that itself can move in the direction x relative to both half-shells shells 14*a* and 14*b*. The locking element 6*c* is coupled with the movement of the first half-shell 14*a*.

The drive construction of FIGS. 4A to 6C can also be combined with the alternative unlocking element according to FIGS. 3A to 3C. With the appropriate deflection elements, the above-described drives can also be used in connection with the locking of sliding doors.

We claim:

1. A magnetic lock comprising:

a magnetically operable latch having a magnetically attractable element movable between a latched position and an unlatched position; and a magnetic operating device spaced from the latch and having a first magnet with a respective magnetic direction and rotatable about a first axis and a second magnet with a respective magnetic direction and rotatable about a second axis, the first and second magnets together forming a magnetic field, each of the magnets being rotatable about the respective axis between a release position with the magnetic direction of one of the rotating magnets generally parallel to and pointing oppositely to the magnetic direction of the other rotating magnet for contracting the magnetic field away from the latch, and a closing position generally parallel to and pointing the same as the magnetic direction of the other rotating magnet for extending the magnetic field to the latch and moving the element to operate the latch magnetically.

2. The magnetic lock according to claim 1, wherein the latch has a permanent-magnet latch element that interacts with the magnetic field and is movable thereby between a latched position and an unlatched position.

3. The magnetic lock according to claim 2, wherein the latch is locked either in the event of an attractive interaction or of a repulsive interaction between the permanent magnet and the first and second magnets.

4. The magnetic lock according to claim 2, wherein the permanent magnet, at least projected onto a normal plane of the axis of rotation, is aligned with the at least one of the first and second magnets.

5. The magnetic lock according to claim 1, further comprising:

a return element that unlocks the latch in the release position of the first magnet when the field is contracted.

6. In combination with the magnetic lock according to claim 1:

a door jamb defining a door opening; and a door panel movable relative to the door jamb between an open position that clears the door opening at least partially and a closed position that closes the door opening, the panel lying generally in a vertical plane, the operating device being on the door panel.

7. The combination according to claim 6, wherein the operating device is on the door panel at a spacing from a side edge of the door panel, there is a spacing between the operating device and the latch.

8. The combination according to claim 6, wherein the latch is on the jamb.

9. The combination according to claim 6, wherein the door panel has a thickness of less than 2 cm.

10. The combination according to claim 6, wherein the door panel is translucent, light-transmitting, or transparent, and made of glass.

11. The combination according to claim 6, wherein the axis of rotation of the first magnet is perpendicular to the door panel.

12. The combination according to claim 6, wherein the latch has a bolt that can be displaced linearly perpendicular to the axis of rotation of the first magnet and positively blocks pivoting of the door panel in the latched position.

13. The combination according to claim 6, wherein the latch has a pivoting strike block carrying the latch element, the strike block positively blocking the door panel in the latched position when the latch element blocks pivoting of the strike block.

14. The combination defined in claim 1, wherein the first magnet is mounted on a vertical face of a door panel and the second magnet is mounted on a vertical opposite face of the panel.

15. The magnetic lock according to claim 1, wherein the first magnet is positioned relative to the second magnet projected onto a normal plane of an axis of rotation of the first magnet in the closing position to an angle of less than 45°.

* * * * *